US009321465B1

(12) United States Patent
Cazares

(10) Patent No.: US 9,321,465 B1
(45) Date of Patent: Apr. 26, 2016

(54) CHILD WALKER TRACK SYSTEM

(71) Applicant: Jose Cazares, Anchorage, AK (US)

(72) Inventor: Jose Cazares, Anchorage, AK (US)

( * ) Notice: Subject to any disclaimer, the term of this patent is extended or adjusted under 35 U.S.C. 154(b) by 0 days.

(21) Appl. No.: 14/509,261

(22) Filed: Oct. 8, 2014

(51) Int. Cl.
*B61B 3/00* (2006.01)
*E01B 25/22* (2006.01)

(52) U.S. Cl.
CPC .. *B61B 3/00* (2013.01); *E01B 25/22* (2013.01)

(58) Field of Classification Search
CPC ..... B61B 3/00; E01B 25/22
USPC ..... 104/93–95, 115
See application file for complete search history.

(56) References Cited

U.S. PATENT DOCUMENTS 4,911,426 A * 3/1990 Scales ..... A61H 3/008 128/845
5,458,550 A * 10/1995 Braim ..... A47D 13/04 297/274
6,058,849 A * 5/2000 Ostholt ..... B66C 7/04 104/139
6,311,625 B1 * 11/2001 Ostrobrod ..... A62B 35/0056 104/115
7,850,026 B2 * 12/2010 McKay ..... B66C 9/10 104/111
7,993,248 B1 * 8/2011 Rasmussen ..... A61H 3/008 482/69
8,561,787 B2 * 10/2013 Wend ..... B65G 19/025 104/172.1
8,893,852 B2 * 11/2014 Liggett ..... A62B 35/0075 104/108
2005/0217531 A1 * 10/2005 Waldmiller ..... B65G 17/20 104/93
2006/0156944 A1 * 7/2006 Vetesnik ..... A62B 35/0056 104/89
2009/0044719 A1 * 2/2009 Schmidt ..... B61B 3/00 105/148
2013/0160668 A1 * 6/2013 Johnston ..... B61B 13/00 104/93
2014/0182476 A1 * 7/2014 Frost ..... B61B 3/00 104/93

* cited by examiner

*Primary Examiner* — Jason C Smith
(74) *Attorney, Agent, or Firm* — Michael J. Tavella

(57) ABSTRACT

A track system that uses a truck that can negotiate curves to allow a curved track system to be used. The track can be all curved or can be a combination of straight and curved tracks. The track can be run also as a straight track if desired. One key element of this system is an attachment bracket that is suspended from the truck that can accept different mounting systems. Thus, a buyer does not necessarily have to purchase a new harness for use with this system. The system is designed to be purchased as a kit. As such, buyers can choose from models that have a complete system including a harness, or just a track system that can be used with an existing harness.

5 Claims, 11 Drawing Sheets

CHILD WALKER TRACK SYSTEM

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to child walkers and particularly to child walkers using a suspended track system.

2. Description of the Prior Art

Infant development has evolved over the years. Infants in the recent past infant jumpers have been developed that allow an infant to bounce unassisted. Such jumpers also allow an infant to stand and practice walking. Most of these systems are fixed in place jumpers that restrict the amount of actual walking an infant can accomplish. For example, U.S. Pat. No. 4,844,452 is A-frame device in which an infant, supported in a sling can bounce and walk in a line by rolling a pulley along the center ridge of the A-frame. Another model uses a clamp found in U.S. Pat. No. 8,056,977 to suspend a jumper from a doorframe of an open door. FIG. 1 is a depiction of this device in use, as prior art. Again, while allowing the child some limited movement, this device essentially keeps the child in one place.

U.S. Pat. No. 5,458,550 teaches a track system that attaches to a ceiling. A wheeled truck is placed in the track and a jumper harness is suspended from it. This allows the child to move along the length of the track. The problem here is that the design is limited to straight runs only and uses a harness designed to be used with that specific track system. Thus, people who might have bought one of the "on door" harnesses would not be able to use that harness on this track system.

BRIEF DESCRIPTION OF THE INVENTION

The instant invention overcomes these difficulties. It is a track system that uses a truck that can negotiate curves to allow a curved track system to be used. The track can be all curved, or can be a combination of straight and curved tracks. Finally, the track can be run as a straight track if desired. One key element of this system is an attachment bracket that is suspended from the truck that can accept different mounting systems. It is possible to use the clamp from U.S. Pat. No. 8,056,977, for example, meaning that a buyer does not necessarily have to purchase a new harness for use with this system.

The system is designed to be purchased as a kit. As such, buyers can choose from models that have a complete system0including a harness, or just a track system that can be used with an existing harness.

DETAILED DESCRIPTION OF THE INVENTION

Figure 1:
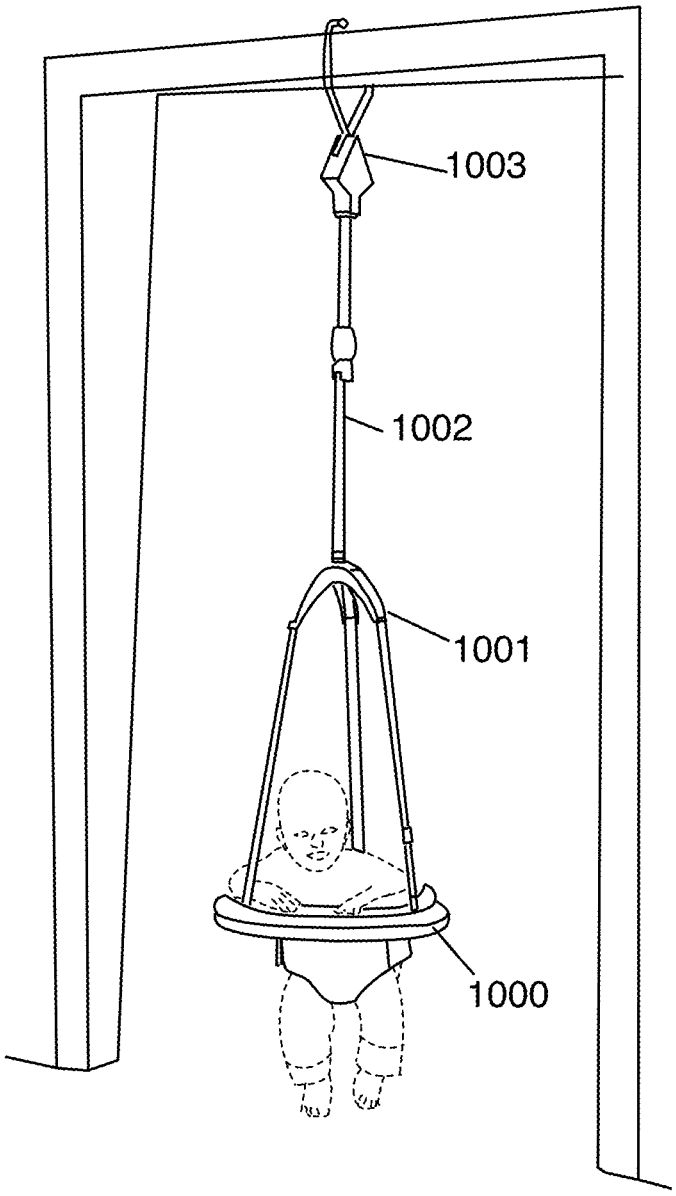
Figure 1 Prior Art
FIG. 1 is a depiction of a child bouncer mounted on a doorframe as prior art.
Figure 2:
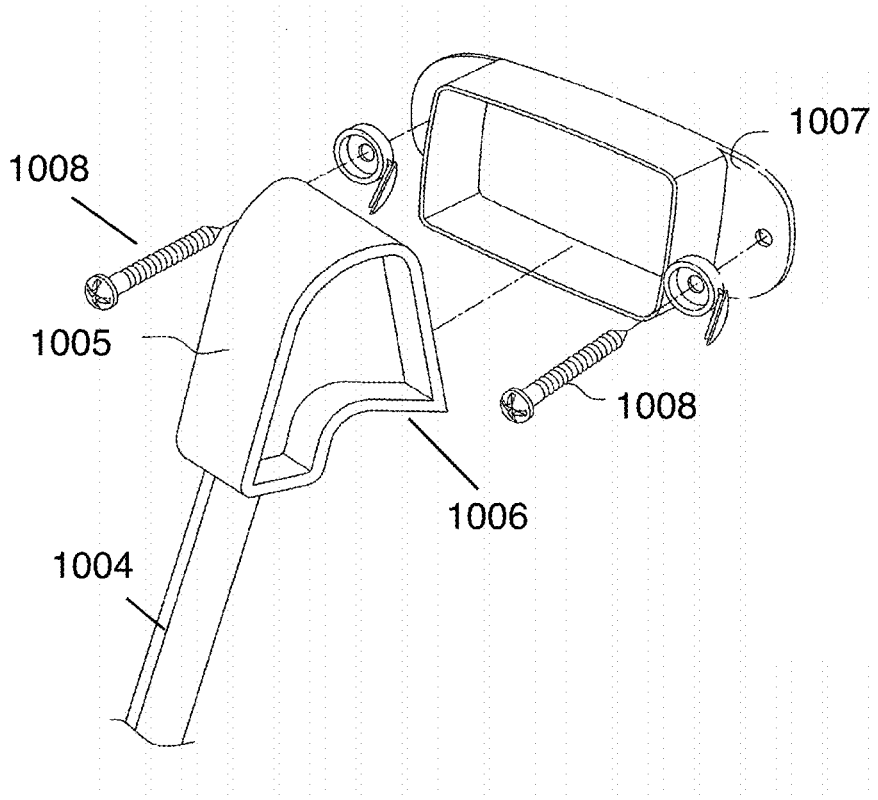
Figure 2 Prior Art
FIG. 2 is a detail view of the clamp used in the device of FIG. 1, as prior art.
Figure 3:
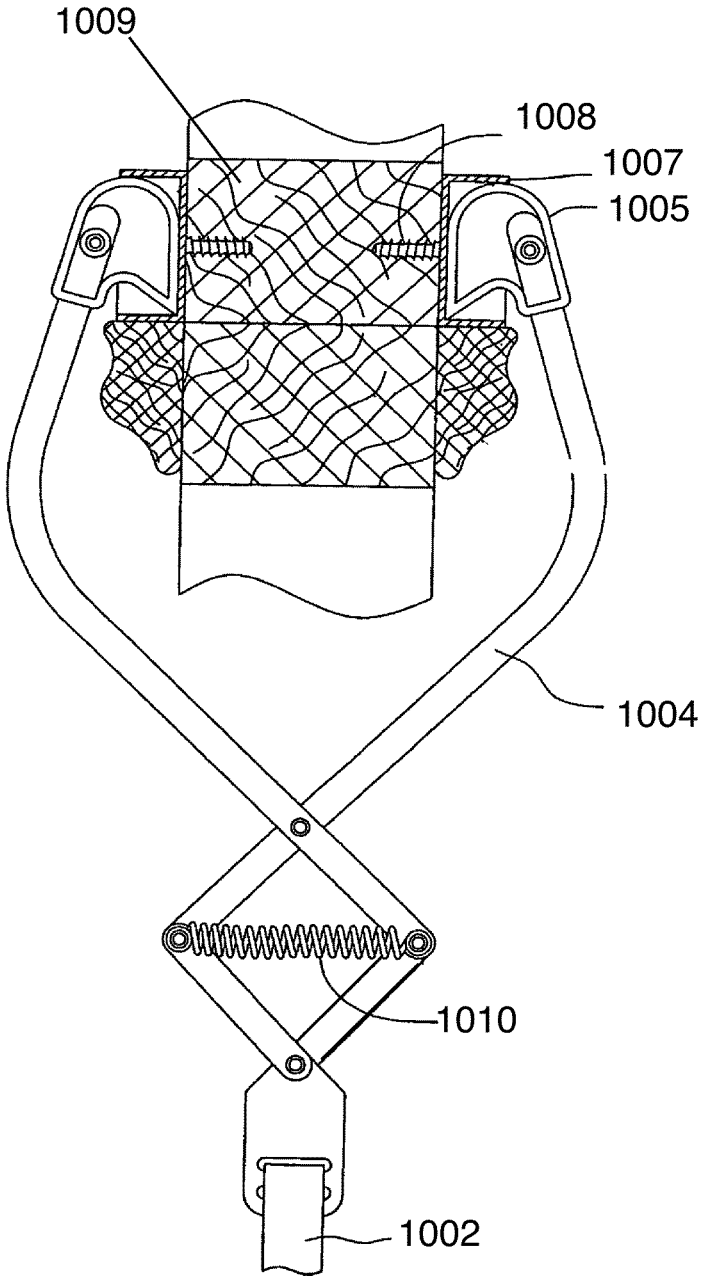
Figure 3 Prior Art
FIG. 3 is a detail view of the clamp of the device of FIG. 1 shown attached to a doorframe, as prior art.

Referring now to FIG. 1, a depiction of a child bouncer mounted on a doorframe as prior art. This device is being discussed because the main invention is designed to be used with bouncers such as the one shown in FIG. 1. This bouncer has a seat 1000, a suspension system 1001, a suspension strap 1002, and a clamp system 1003. The clamp system is designed to be secured to a doorframe. FIGS. 2 and 3 show the clamp system 1003 as used with a doorframe. FIG. 2 is a detail view of a portion of the clamp system 1003 used in the device of FIG. 1, as prior art. Here a clamp arm 1004 is shown having a head 1005 with a hook 1006. This clamp arm is placed in a receptacle 1007 that is secured to a doorframe using fasteners 1008. FIG. 3 is a detail view of the clamp of the device of FIG. 1 shown attached to a doorframe, as prior art. In this view, the doorframe 1009 is shown. The receptacles 1007 are shown with the clamp arms 104 installed in them. In this way, the system is suspended, ready for use. As discussed above, the limitation f this system is that it is fixed in place on the doorframe. While it can be moved from place to place, when in use, it is limited to where it is installed.

As discussed above, the instant invention is a track system that can be mounted on any ceiling. This gives the infant, who s suspended in the seat of a bouncer, the ability to move about a room along the track. As discussed below, unlike other track systems, this system allows for curved tracks as well as the ability to use any type of suspension hook system available.

Figure 4:
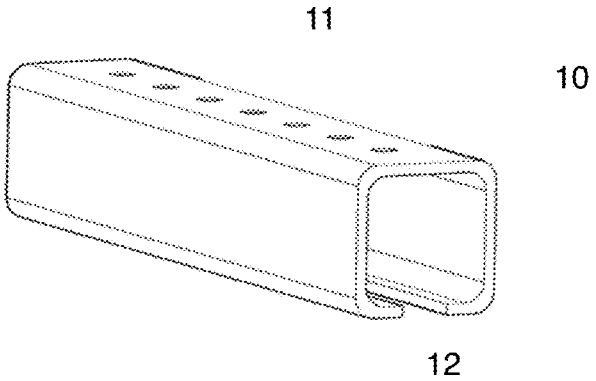
FIG. 4 is a perspective view of a short length of straight track as part of the instant invention.

Referring now to FIG. 4, a perspective view of a short length of straight track 10 is shown. This track is the basic component of the system. The track 10 has a number of holes 11 in the top of the track to mount the track to a ceiling. Note that the track is generally square in shape and has an open slot 12 running along the bottom. Note too, in the preferred embodiment, each piece of track normally has length of four feet, although it can be made in eight and ten foot lengths as well.

Figure 5:
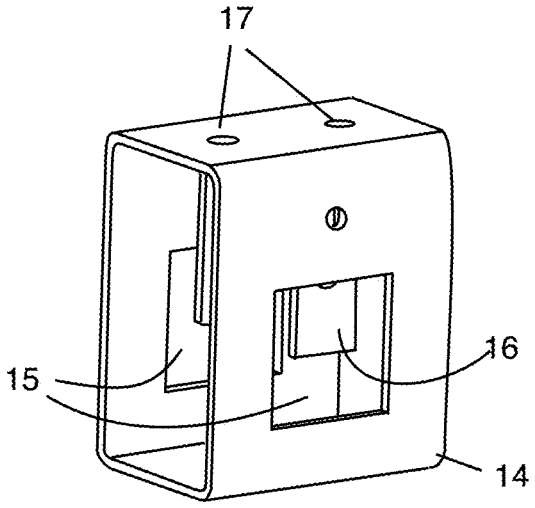
FIG. 5 is a perspective view of the clamp bracket as part of the instant invention.

FIG. 5 is a perspective view of the clamp bracket 14 as part of the instant invention. This is the key to this device. The clamp bracket 14 is a rectangular box having a pair of opposed openings 15 cut into the side walls, as shown. Each side wall also has amounting hole for the locking plate 16 (see FIGS. 12-14 below). The clamp bracket 14 also has two mounting holes 17 for connecting the truck, which are considered, along with appropriate fasteners, to be a means for attaching the truck to the clamp bracket, as discussed below. Note too that the ends of the clamp bracket are open as shown.

Figure 6:
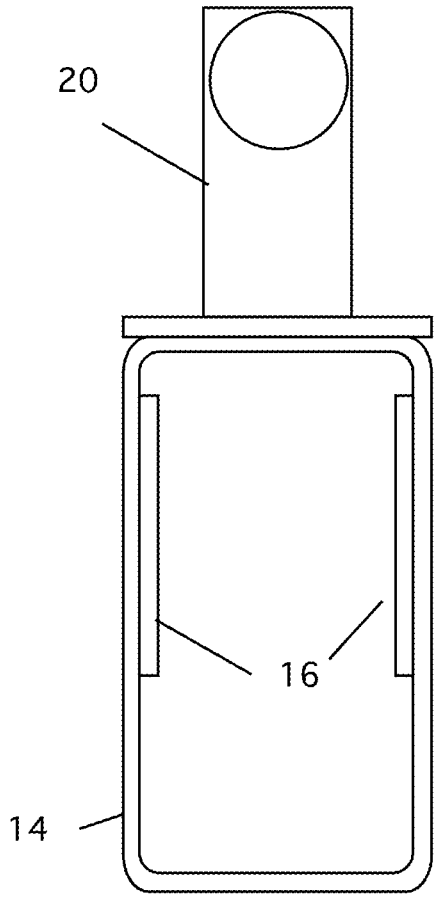
FIG. 6 is a front view of the clamp bracket with the guide truck mounted thereon.

FIG. 6 is a front view of the clamp bracket 14 with the guide truck 20 mounted thereon. Here, the clamp bracket 14 is shown from one of the open ends. Note that the locking plates 16 are shown in position. The truck 20 is secured to the top of the clamp bracket 14 using standard fasteners and the mounting holes 17.

Figure 7:
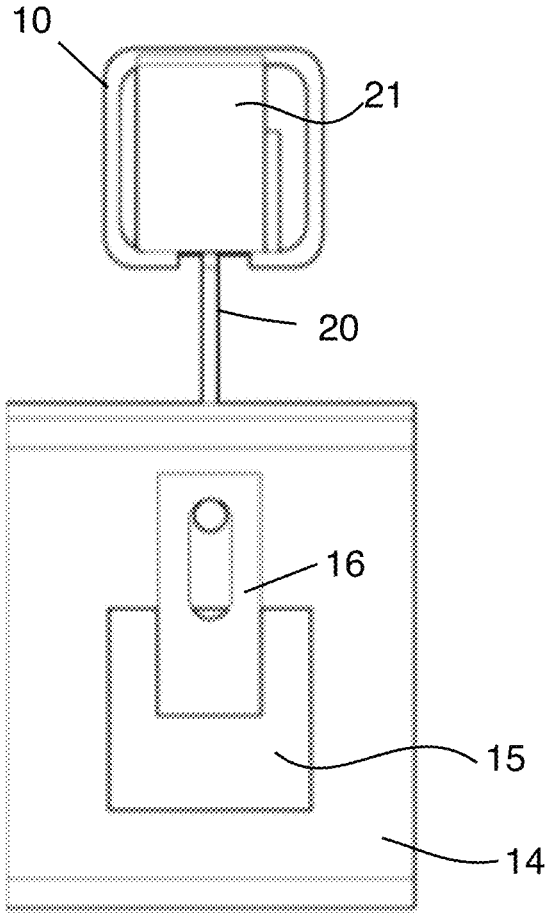
FIG. 7 is a cross sectional view of the clamp bracket and showing the guide truck mounted in the track.

FIG. 7 is a cut away view of the clamp bracket 14 and showing the locking plate 16 mounted in the clamp bracket. The figure also shows the truck 20 mounted in the track 10 with the stop 21 in place.

Figure 8:
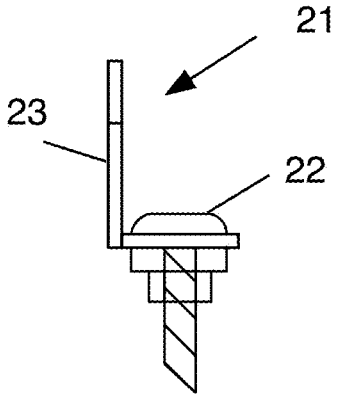
FIG. 8 is a detail view of the stop screw.

FIG. 8 is a detail view of the stop 21 that consists of a screw 22 and plate 23. This screw is simple fitted into the end of the track after the truck is installed, as a safety measure.

Figure 9:
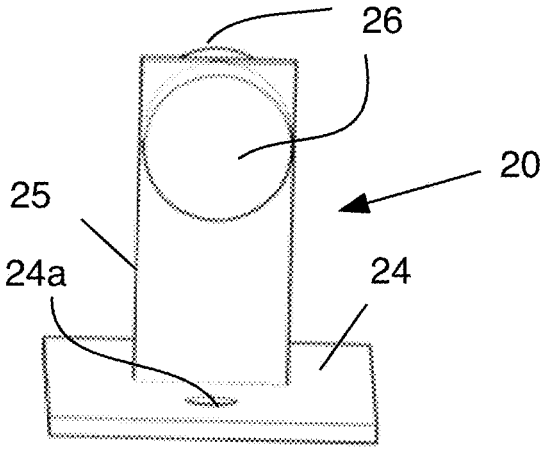
FIG. 9 is a perspective view of the guide truck.

FIG. 9 is a perspective view of the guide truck 20. The truck 20 has a base plate 24 that has mounting holes 24*a*, a riser plate 25 and a pair of wheels 26, as shown. The wheels ride in the track and propel the unit forward.

Figure 10:
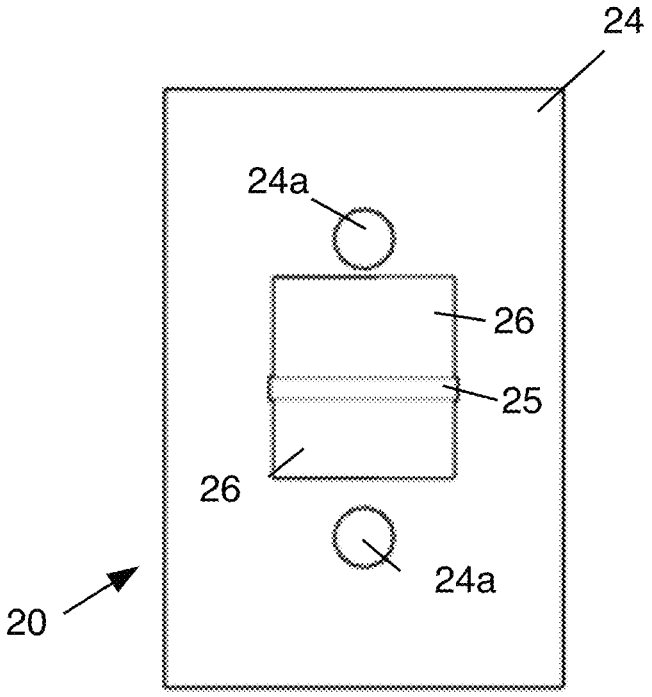
FIG. 10 is a top view of the guide truck.
Figure 11:
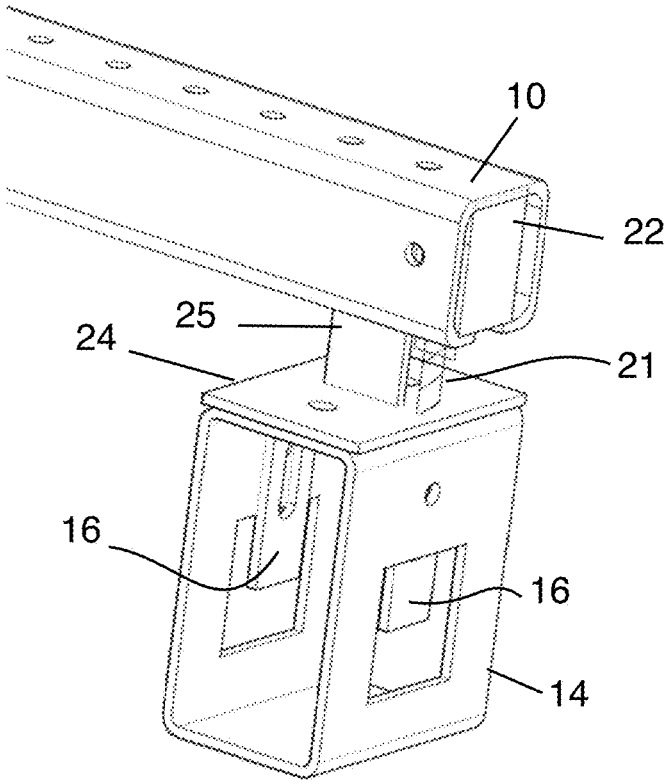
FIG. 11 is a perspective view of the clamp bracket mounted in the track. This view shows the placement of the stop screw.

FIG. 10 is a top view of the guide truck. The base plate 24 that has mounting holes 24*a*, a riser plate 25 and a pair of wheels 26, as shown FIG. 11 is a perspective view of the clamp bracket mounted in the track. This view shows the placement of the stop screw. Here, the clamp bracket 14 is shown in place under the track. As before, the truck 20 is inside the track 10. Note that the locking plates 16 are shown in the clamp bracket 14.

Figure 12:
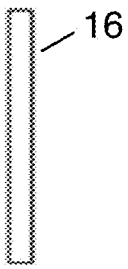
FIG. 12 is a side view of the clamp bracket locking plate.
Figure 13:
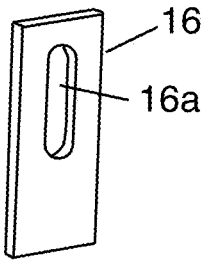
FIG. 13 is a perspective view of the clamp bracket locking plate.
Figure 14:
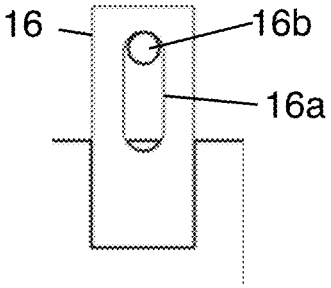
FIG. 14 is a front view of the clamp bracket locking plate.

FIG. 12 is a side view of the clamp bracket locking plate 16. FIG. 13 is a perspective view of the clamp bracket locking plate. FIG. 14 is a front view of the clamp bracket locking plate. In these views the locking plate 16 is shown. Each locking plate has a slot 16*a* that is used to place a fastener 16*b* through to secure it to the clamp bracket 14. The use of the locking bracket is shown below.

Figure 15:
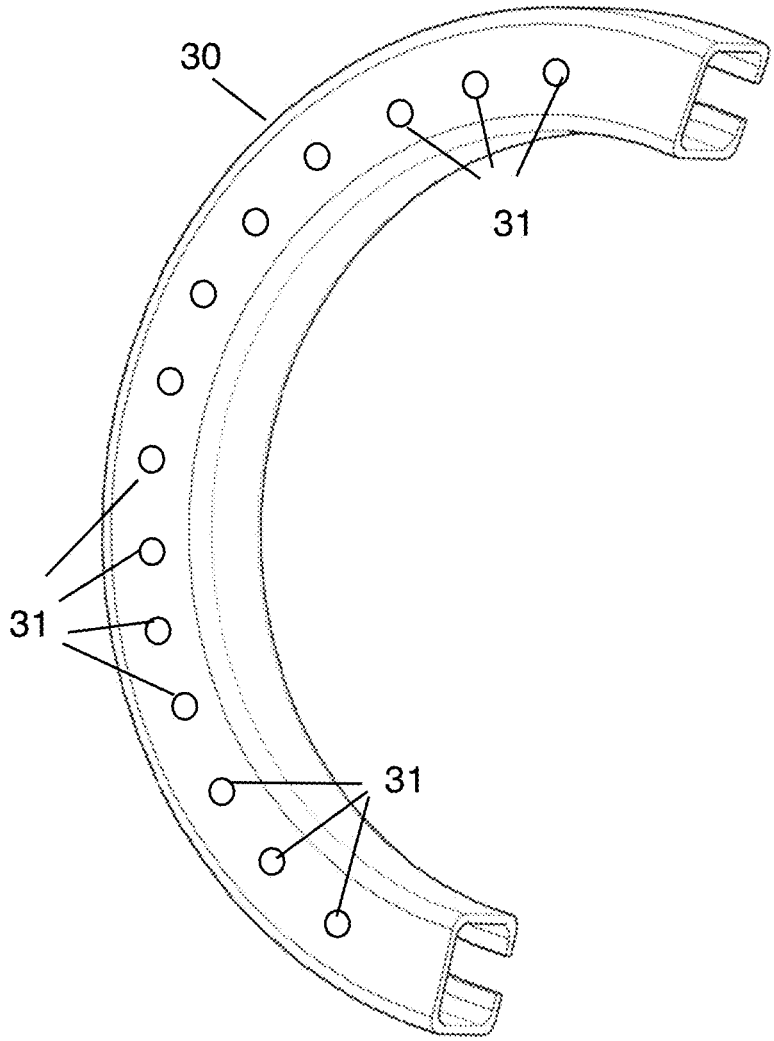
FIG. 15 is a detail view of a length of curved track.

FIG. 15 is a detail view of a length of curved track. As noted above, this system can use curved track 30. This track has mounting holes 31 and has the same cross section as the straight track. This allows users to place a combination of straight and curved tracks to make different courses for the infant to follow. The use of the combination of straight and curved tracks makes this system unique.

Figure 16:
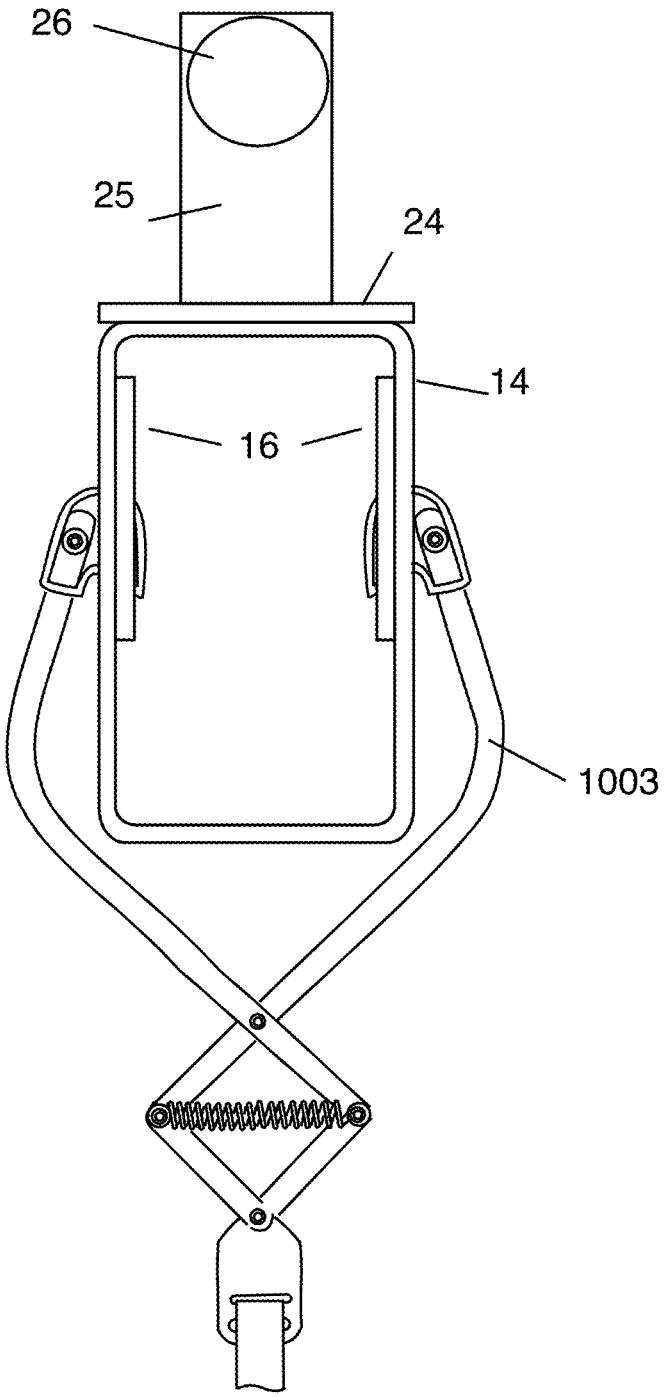
FIG. 16 is a detail view of the clamp bracket showing a bouncer clamp secured therein.

FIG. 16 is a detail view of the clamp bracket showing a bouncer clamp secured therein. In this view, the clamp system 1003 of the prior art device is shown secured in the clamp bracket 14. Unlike the prior art system, there are no mounted receptacles to secure the clamp arms. However, after the clamp arms are placed in the holes 15 of the clamp bracket, the locking plates are lowered until the clamp arms are secured. The fasteners on the locking plates are tightened, locking the arms in place. Once secured, a child can move freely around a room following the track.

It is also possible to use other types of connectors to attach the baby sling to the clamp bracket. For example, a strap can pass through the openings 15 in the bracket and the strap can be secured with a clamp. Devices such as hooks, or even a straight bar can be used with the clamp bracket as well.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A child walker track system comprising:

a) a length to track;

b) a truck, having a pair of wheels, a center bracket, descending from said pair of wheels and a base plate, said truck being operable positioned in said length of track;

c) a clamp bracket being a generally rectangular box having a pair of opposed side walls having openings therein and an open front and an open back;

d) a pair of locking plates slidably attached to said clamp bracket and being aligned with said openings in said pair of side walls; and e) a means for attaching said clamp bracket to said truck.

2. The child walker track system of claim 1 further comprising a stop plate, attached to said track.

3. The child walker track system of claim 1 wherein the length of track comprises a length of straight track.

4. The child walker track system of claim 1 wherein the length of track comprises a length of curved track.

5. The child walker track system of claim 1 wherein the length of track comprises a combination of straight and curved track portions aligned to form a path.

* * * * *